US008845071B2

(12) United States Patent
Yamamoto et al.

(10) Patent No.: US 8,845,071 B2
(45) Date of Patent: Sep. 30, 2014

(54) INKJET PRINTING APPARATUS

(75) Inventors: Takaharu Yamamoto, Kyoto (JP); Hiroyuki Fuchioka, Kyoto (JP)

(73) Assignee: DaiNippon Screen Mfg. Co., Ltd. (JP)

( * ) Notice: Subject to any disclaimer, the term of this patent is extended or adjusted under 35 U.S.C. 154(b) by 263 days.

(21) Appl. No.: 12/905,746

(22) Filed: Oct. 15, 2010

(65) Prior Publication Data

US 2011/0242203 A1 Oct. 6, 2011

(30) Foreign Application Priority Data

Mar. 30, 2010 (JP) ..... 2010-78488

(51) Int. Cl.
*B41J 2/165* (2006.01)

(52) U.S. Cl.
CPC ..... *B41J 2/16508* (2013.01); *B41J 2/16523* (2013.01)
USPC ..... 347/30

(58) Field of Classification Search
None
See application file for complete search history.

(56) References Cited

U.S. PATENT DOCUMENTS

| | | | | |
|---|---|---|---|---|
| 7,246,874 | B2 * | 7/2007 | Hirakata et al. | 347/29 |
| 7,410,248 | B2 * | 8/2008 | Umeda et al. | 347/85 |
| 2002/0186271 | A1 * | 12/2002 | Yamada et al. | 347/30 |
| 2006/0268051 | A1 | 11/2006 | Umeda et al. | |
| 2008/0174631 | A1 | 7/2008 | Habashi | |
| 2009/0015625 | A1 | 1/2009 | Sumida | |

FOREIGN PATENT DOCUMENTS

| | | |
|---|---|---|
| JP | 2-1325 | 1/1990 |
| JP | 3133716 | 11/2000 |
| JP | 2007-8156 | 1/2007 |
| JP | 2008-179056 | 8/2008 |
| JP | 2008-213216 | 9/2008 |
| JP | 2009-83388 | 4/2009 |
| WO | 2007/058139 | 5/2007 |

OTHER PUBLICATIONS

Corresponding Japanese Application No. 2010-078488, Office Action issued Apr. 23, 2013.

* cited by examiner

*Primary Examiner* — Alejandro Valencia
(74) *Attorney, Agent, or Firm* — Ostrolenk Faber LLP

(57) ABSTRACT

An inkjet printing apparatus is provided, which has a simple construction, and is yet capable of reducing ink consumption and cleaning inkjet heads promptly.

The inkjet printing apparatus includes connector caps 51*a*-51*l* for connecting tubes communicating with suction caps, a cap support 54 supporting the connector caps 51*a*-51*l*, a switch element 60 for switching to a sucking state one of the connector caps 51*a*-51*l* to which the tubes are connected, and a stepping motor 57 for supporting and rotating the switch element 60.

2 Claims, 5 Drawing Sheets

INKJET PRINTING APPARATUS

BACKGROUND OF THE INVENTION

1. Field of the Invention

This invention relates to an inkjet printing apparatus including a plurality of inkjet heads.

2. Description of the Prior Art

Conventionally, in an inkjet printing apparatus including inkjet heads each having numerous inkjet nozzles, cleaning by suction (suction purge) is carried out for the inkjet heads in order to eliminate a printing failure called missing nozzle due to clogging of part of the inkjet nozzles.

The inkjet recording apparatus described in Japanese Unexamined Patent Publication No. 2008-213216, for example, includes caps for individually covering discharge opening groups (inkjet heads), a pump for drawing ink by suction from ink discharge openings (inkjet nozzles) into the caps, and switch valves respectively mounted on connecting paths connecting the individual caps to the pump. In this inkjet recording apparatus, by selectively opening the switch valves mounted on the connecting paths communicating with the respective caps of the discharge opening groups (inkjet heads), for example, only the cap covering an inkjet head which includes an inkjet nozzle failing to discharge ink can be connected to the pump, to undergo a suction purge for individually sucking the ink.

An inkjet printing apparatus has also been proposed, which includes a cleaning mechanism capable of a general suction which carries out suction for a plurality of inkjet heads collectively, and an individual suction for only one inkjet head (see International Publication No. 2007/058139). This cleaning mechanism is formed of a cap for individual suction, which is one of caps for individually covering a plurality of inkjet heads, and which may be connected to a pump through a tube, the other caps being connected to the pump through a tube branched to be connected to the plurality of caps, a first switch valve for switching sucking operation of the plurality of caps at the same time, and a second switch valve for switching sucking operation of only the cap for individual suction. When carrying out the general suction, all the plurality of inkjet heads are covered with the caps, and the first and second switch valves are opened. When carrying out the individual suction, only one inkjet head is covered with the cap for individual suction, the first switch valve is closed, and the second switch valve is opened, thereby allowing the desired inkjet head to undergo the suction.

However, with the apparatus described in Japanese Unexamined Patent Publication No. 2008-213216, it is necessary to arrange numerous electromagnetic switch valves corresponding to the number of caps, which poses a problem of enlarging the apparatus and increasing production cost. Driving the numerous electromagnetic switch valves also poses a problem of increasing power consumption, and thus increasing running cost.

On the other hand, the apparatus described in International Publication No. 2007/058139 carries out a cleaning operation for each inkjet unit having a plurality of inkjet heads juxtaposed in one direction. Therefore, when an individual suction of the inkjet heads is carried out, depending on the position in an inkjet unit of the inkjet head requiring suction, an extended time is consumed in moving the inkjet unit for positioning the inkjet head relative to the cap for individual suction. This poses a problem of taking a long time in cleaning the inkjet head.

SUMMARY OF THE INVENTION

The object of this invention, therefore, is to provide an inkjet printing apparatus having a simple construction, and yet capable of reducing ink consumption and cleaning inkjet heads promptly.

The above object is fulfilled, according to this invention, by an inkjet printing apparatus having a plurality of inkjet heads each with a plurality of inkjet nozzles, a plurality of caps respectively corresponding to the plurality of inkjet heads, a plurality of pipelines respectively connected to the plurality of caps, and a suction device for sucking ink from the plurality of inkjet nozzles through the plurality of caps and the plurality of pipelines, the apparatus comprising a connection switching device including a suckout port connected to the suction device; a switch element connected to and rotatably supported by a driving device, the switch element having a communication path formed therein to communicate with the suckout port; and a plurality of intake ports arranged equidistantly from a rotation center of the switch element, the plurality of pipelines being connectable to the intake ports; wherein the plurality of pipelines are selectively connected to the suction device by rotating the switch element to move the communication path to a position for communicating with one of the intake ports.

Such inkjet printing apparatus, with the connection switching device for selectively connecting the plurality of pipelines to the suction device, can reduce consumption of the ink due to a suction purge of the inkjet heads not requiring the suction purge. The apparatus can also carry out selectively quick cleaning of the plurality of inkjet heads.

In one preferred embodiment, the inkjet printing apparatus has a plurality of inkjet heads for a single ink color.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
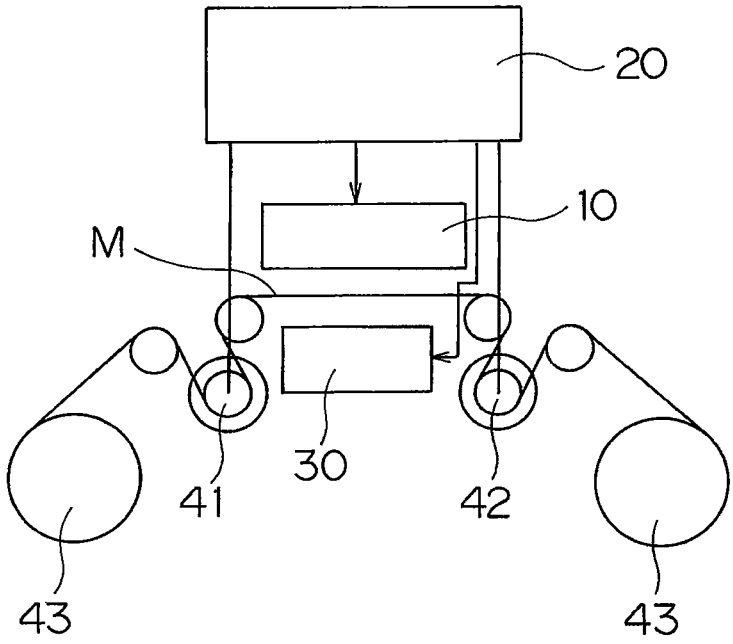
FIG. 1 is a schematic view of an inkjet printing apparatus according to an embodiment of this invention.

An embodiment of this invention will be described hereinafter with reference to the drawings. FIG. 1 is a schematic view illustrating an inkjet printing apparatus according to the embodiment of this invention.

This inkjet printing apparatus is constructed to carry out printing by discharging inks from inkjet nozzles to a long recording medium M wound on a pair of winding rollers 43 and moving in one direction as driven by a drive motor 41. The apparatus includes a controller 20, an inkjet head group 10 and a cleaning section 30.

The controller 20, based on image information and others, performs printing controls such as driving the drive motor 41, monitoring an amount of movement of the recording medium M by an encoder 42 and adjustment of ink discharge from the inkjet nozzles. The controller 20 also controls operation of the cleaning section 30 for cleaning inkjet heads 110 (see FIGS. 2 and 3).

The inkjet head group 10 includes inkjet units 100 for respective ink colors of Y (yellow), M (magenta), C (cyan) and K (black) arranged in the direction of movement of the recording medium M. Each inkjet unit 100 has a plurality of inkjet heads 110, each with numerous inkjet nozzles, arranged in the direction of width of the recording medium M which is perpendicular to the direction of movement of the recording medium M. Thus, this inkjet printing apparatus performs what is called one-pass printing in which printing is completed with the recording medium M once passing under the inkjet head group 10, without reciprocating the inkjet heads 110 in directions perpendicular to the direction of movement of the recording medium M.

Figure 2:
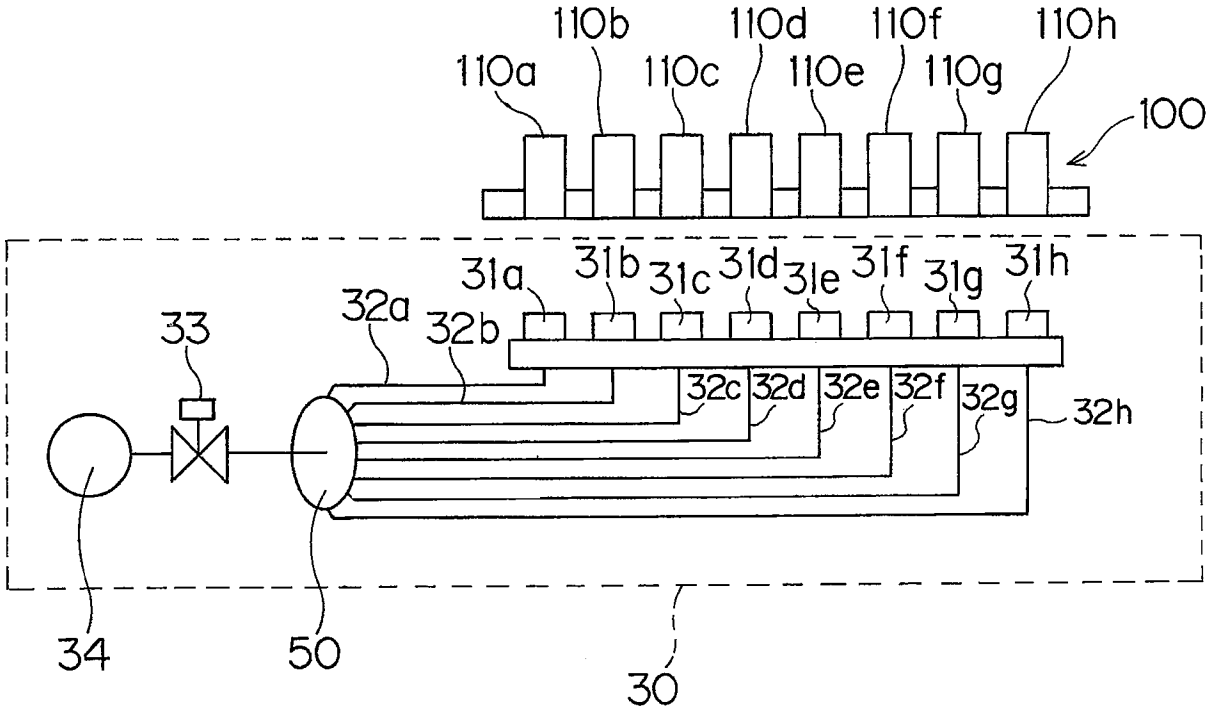
FIG. 2 is a schematic view showing a cleaning section along with an inkjet unit.
Figure 3:
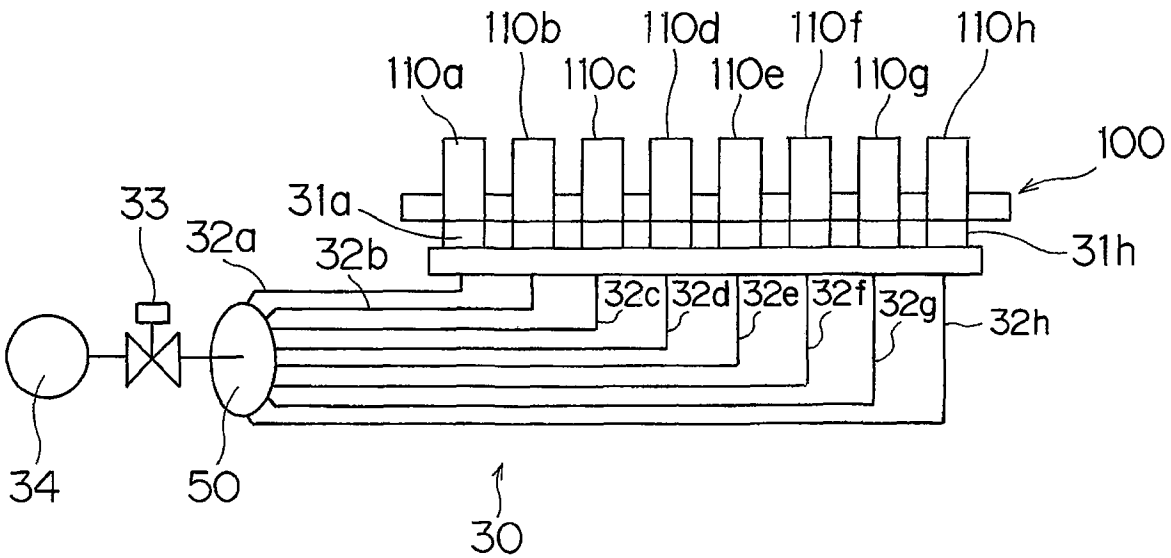
FIG. 3 is a schematic view showing the cleaning section along with the inkjet unit.
Figure 4:
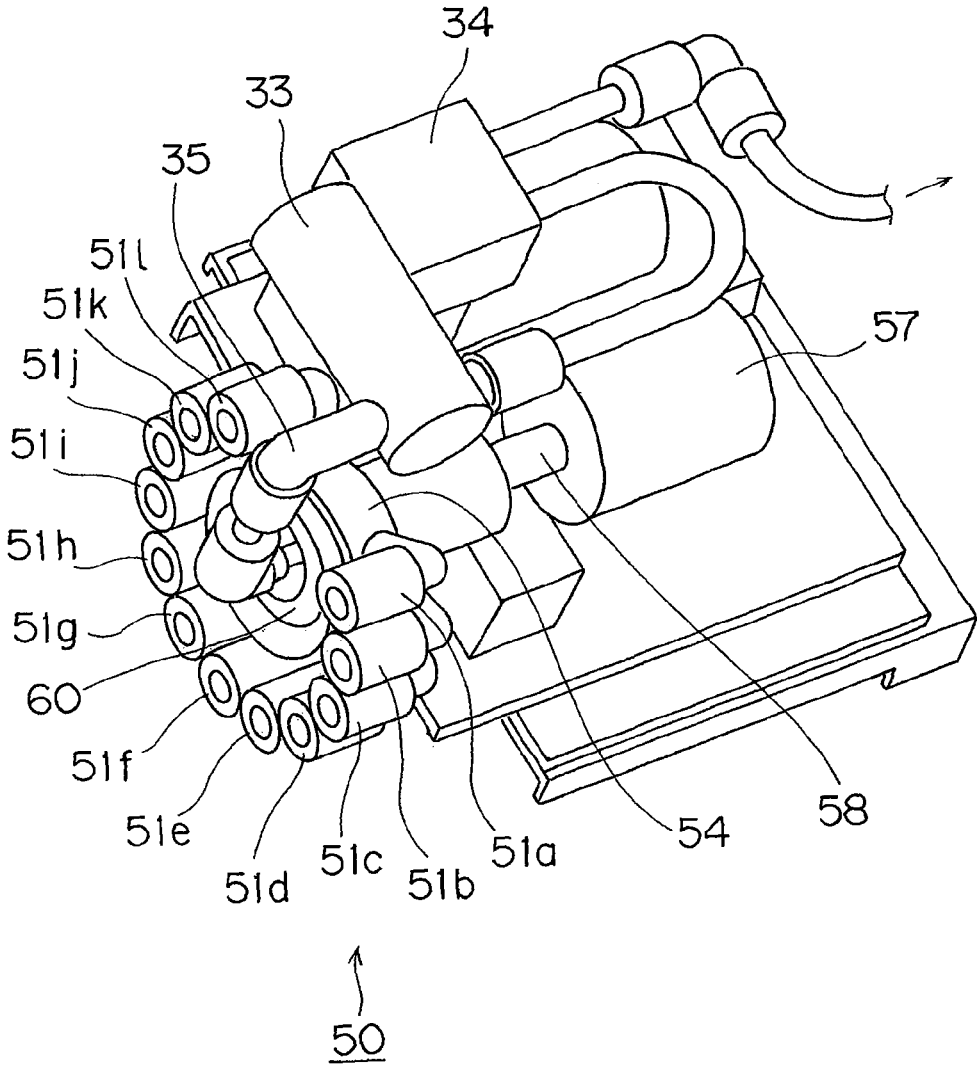
FIG. 4 is a perspective view showing a connection switching device and adjacent components.
Figure 5:
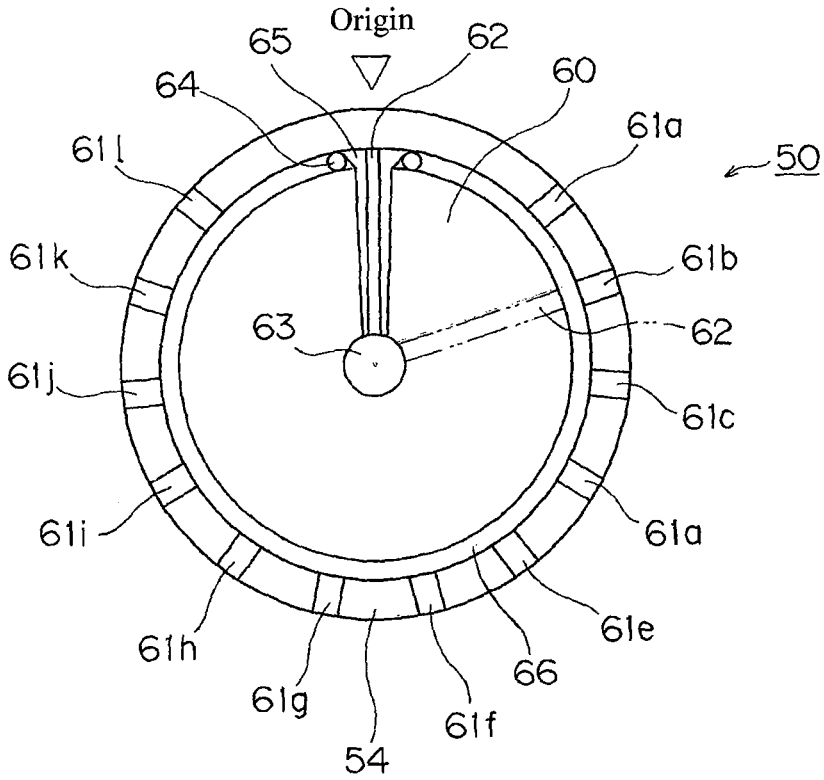
FIG. 5 is an outline sectional view of a switching element of the connection switching device.

FIGS. 2 and 3 are schematic views showing the cleaning section 30 along with an inkjet unit 100 of this inkjet recording apparatus. FIG. 4 is a perspective view showing a connection switching device 50 and adjacent components of the cleaning section 30. FIG. 5 is an outline sectional view of a switch element 60 of the connection switching device 50. In this inkjet recording apparatus, the cleaning section 30 cleans inkjet heads 110*a*-110*h* (which may be collectively called "inkjet heads 110") on the basis of each inkjet unit 110. In this embodiment, an inkjet unit 110 with a juxtaposition of eight inkjet heads 110*a*-110*h* will be described by way of example.

The cleaning section 30 includes a connection switching device 50 to be described hereinafter, suction caps 31*a*-31*h* (which may be collectively called "suction caps 31") for covering, respectively, the eight inkjet heads 110*a*-110*h* juxtaposed on the inkjet unit 100, tubes 32*a*-32*h* (which may be collectively called "tubes 32") connecting the respective suction caps 31*a*-31*h* to the connection switching device 50, a suction pump 34 acting as a suction device for applying suction to the respective suction caps 31*a*-31*h*, and an electromagnetic switch valve 33 mounted on pipeline 35 extending between the connection switching device 50 and suction pump 34. When cleaning the inkjet heads 110, the inkjet unit 100 moves from a printing position for executing printing to a cleaning position shown in FIG. 3 where the respective inkjet heads 110*a*-110*h* are covered by the suction caps 31*a*-31*h*.

The connection switching device 50, as shown in FIG. 4, includes connector caps 51*a*-51*l* (which may be collectively called "connector caps 51") for connection with the tubes 32*a*-32*h*, a cap support 54 for supporting the connector caps 51*a*-51*l*, a switch element 60 for switching to a sucking state one of the connector caps 51*a*-51*l* to which the tubes 32*a*-32*h* are connected, and a stepping motor 57 acting as a driving device for supporting and rotating the switch element 60. In this embodiment, the number of connector caps 51 of the connection switching device 50 is 12, and thus up to 12 tubes 32 can be connected. It is assumed that the tubes 32*a*-32*h* are connected to the connector caps 51*a*-51*h* corresponding in alphabet, respectively.

The switch element 60 has a circular shape with a suckout port 63 formed centrally thereof for discharging objects sucked into the connection switching device 50 out of the connection switching device 50, and with a communication path 62 formed inside to extend from the suckout port 63 to a peripheral position. The stepping motor 57 connected to the back of the switch element 60 through a shaft 58 rotates the switch element 60 to move the communication path 62 to a position for communicating with intake ports 61*a*-61*l* (which may be collectively called "intake ports 61") of the cap support 54 to be described hereinafter. The suckout port 63 is connected to the pipeline 35 communicating with the electromagnetic switch valve 33 to be described hereinafter.

As shown in FIG. 5, the cap support 54 has bores (intake ports 61*a*-61*l*) formed to surround the switch element 60 and equidistantly from the rotation center of the switch element 60 for leading into the connection switching device 50 the objects sucked through the suction caps 31*a*-31*h* and tubes 32*a*-32*h*. The intake ports 61*a*-61*l* are formed at regular intervals and in the number corresponding to the connector caps 51*a*-51*l*.

A gap 66 is formed between the switch element 60 and cap support 54 to facilitate rotation of the switch element 60. An O-ring 64 is disposed as a seal member in the gap 66 between the communication path 62 and intake ports 61 in order that the communication path 62 of the switch element 60 communicates with the intake ports 61 of the cap support 54 without the gap. With rotation of the switch element 60 as driven by the stepping motor 57, this O-ring 64 moves through the gap 66 between the switch element 60 and cap support 54. In order to support this O-ring 64, a contact support member 65 is disposed in the communication path 62.

Figure 6:
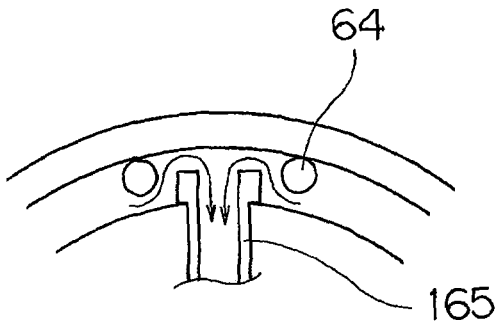
FIG. 6 is an explanatory view showing, in enlargement, a portion adjacent an O-ring where a contact support member having a different shape is used.

The contact support member 65 has a substantially cylindrical hollow shape, and contacts and supports the O-ring 64 in the gap 66 between the switch element 60 and cap support 54. The contact support member 65 has a surface for contacting the O-ring 64, and this contact surface has a taper such that its outer shape becomes larger toward the intake ports 61 of the cap support 54. FIG. 6 is an explanatory view showing, in enlargement, a portion adjacent the O-ring 64 where use is made of a contact support member 165 having a different shape to the contact support member 65 in this embodiment.

In a gap between concentric circular shapes like the gap 66 between the switch element 60 and cap support 54, in which the O-ring 64 contacts arcuate surfaces, a deformation force acts on the O-ring 64 whereby, as shown in FIG. 6, gaps will occur between the O-ring 64 and switch element 60 to impair the sealing function. Therefore, in this embodiment, a taper is formed on the surface of the contact support member 65 contacting the O-ring 64 to resist the deformation force acting on the O-ring 64, thereby enabling a close connection between the communication path 62 and intake ports 61, without impairing the sealing function of the O-ring 64.

Next, an operation for cleaning the inkjet heads 110 will be described.

In the state shown in FIG. 2, in which the inkjet heads 110*a*-110*h* are not covered by the suction caps 31*a*-31*h*, the communication path 62 of the switch element 60 is directed to the origin (position shown in solid lines in FIG. 5) to communicate with none of the intake ports 61*a*-61*l* formed in the cap support 54. At this time, the electromagnetic switch valve 33 is closed, and none of the suction caps 31*a*-31*h* are engaged in suction.

When the inkjet unit 100 moves to the cleaning position shown in FIG. 3, the switch element 60 is rotated by the stepping motor 57 whereby the communication path 62 moves to a position (e.g. the position shown in phantom lines in FIG. 5) for communication with one of the intake ports 61*a*-61*l* formed in the cap support 54. At this time, the electromagnetic switch valve 33 is opened. Consequently, only the suction cap 31*b* connected through the connector cap 51*b* and tube 32*b* to the intake port 61*b* in communication with the communication path 62 is connected to the suction pump 34, thereby executing a suction purge. Ink or other substance drawn by suction from the inkjet nozzles of the inkjet head 110*b* to the suction cap 31*b* is discharged out of the apparatus via the tube 32*b*, intake port 61*b*, communication path 62, suckout port 63, electromagnetic switch valve 33 and suction pump 34.

When an individual suction for an inkjet head 110 is desired, as described above, suction may be executed after aligning the position of the intake port 61 connected to the suction cap 31 corresponding to the inkjet head 110 for which a suction purge is desired and the position of the communication path 62, by rotating the switch element 60.

With the flow path connections being selectively switchable as above, when a suction purge is desired for a plurality of inkjet heads 110, e.g. when a suction purge is desired for the inkjet heads 110*b*, 110*f* and 110*h*, the flow path connections may be switched by rotating the switch element 60 to place the communication path 62 in communication with the intake ports 61*b*, 61*f* and 61*h* in the stated order, and the electromagnetic switch valve 33 opened and closed repeatedly. Further, when a general suction is desired for the inkjet head 110, the flow path connections may be switched by rotating the switch element 60 to move the communication path 62 successively relative to the intake ports 61*a*-61*h*, for example, and the electromagnetic switch valve 33 opened and closed repeatedly as corresponding to the flow path connection switching. After a suction purge is carried out for all the inkjet heads 110*a*-110*h*, the stepping motor 57 may be operated to return the position of the communication path 62 to the origin to communicate with none of the intake ports 61*a*-61*l*.

In this embodiment, as described above, the flow paths for cleaning, individually connected to a plurality of inkjet heads 110, can be switched easily and quickly only by rotating the switch element 60. For both the individual suction and general suction, a cleaning operation can be carried out in a short time. A greater effect of shortening the cleaning time by individual suction can be secured with the inkjet recording apparatus which uses many inkjet heads 110 for each ink color, as where three or more inkjet heads 110 are arranged for a single ink color.

In the foregoing embodiment, the number of tubes connectable to the connection switching device 50 is 12. However, this invention is not limited to this number, as long as it is more than the number of inkjet heads 110 arranged on one inkjet unit 100, for example. Further, although the switch element 60 of the connection switching device 50 employed in the foregoing embodiment is shaped circular, its shape can be polygonal instead.

The foregoing embodiment has been described with relation to an operation for cleaning the inkjet heads 110 having inkjet nozzles for discharging ink. The connection switching device 50 described hereinbefore is applicable also to cleaning of a plurality of inkjet heads having nozzles for discharging various solvents other than ink, such as a coating agent.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2010-78488 filed in the Japanese Patent Office on Mar. 30, 2010, the entire disclosure of which is incorporated herein by reference.

What is claimed is:

1. An inkjet printing apparatus having a plurality of inkjet heads for discharging common fluid, each with a plurality of inkjet nozzles, connected for receiving the common fluid, being arranged in a line extending across the direction of width of a recording medium and said line extending perpendicular to the direction of movement of the recording medium, for completely printing the recording medium in one pass under the plurality of inkjet heads, the apparatus including a plurality of caps respectively corresponding to the plurality of inkjet heads on a one-to-one basis, a plurality of pipelines corresponding respectively to the plurality of caps, and a suction device for sucking said fluid from the plurality of inkjet nozzles through the plurality of caps and the plurality of pipelines, the apparatus comprising a connection switching device including:

a suckout port connected to the suction device;

a disk-shaped switch element connected to and rotatably supported by a driving device, the switch element having no more than one communication path formed in a rotation center thereof to communicate with the suckout port and to extend to a peripheral position of the switch element;

a plurality of intake ports arranged equidistantly from a rotation center of the switch element at regular angular intervals, the plurality of pipelines being connectable to the intake ports; and a switch valve disposed between the suckout port and the suction device;

wherein the plurality of pipelines are selectively connected to the suction device by rotating the switch element to move the communication path to a position for communicating with one of the plurality of intake ports, the switch valve is controlled to be closed during rotation of the switch element, and the switch valve is controlled to be opened in response to the communication path being located in a position for communicating with a desired intake port, a gap being formed between the switch element and the intake ports;

the switch element further comprising a seal member disposed adjacent an end of the communication path, for sealing the communication path between the communication path and the intake ports, and a contact support member in the communication path, for supporting the seal member; and the contact support member being tapered, having an outer shape becoming larger toward the intake ports.

2. The inkjet printing apparatus according to claim 1, wherein said single fluid is a single ink color.

* * * * *